US008894047B2

(12) United States Patent
Himmelsbach

(10) Patent No.: US 8,894,047 B2
(45) Date of Patent: Nov. 25, 2014

(54) STIRRING ARRANGEMENT

(75) Inventor: Werner Himmelsbach, Rheinfelden (DE)

(73) Assignee: Ekato Ruehr- und Mischtechnek GmbH, Schopfheim (DE)

( * ) Notice: Subject to any disclaimer, the term of this patent is extended or adjusted under 35 U.S.C. 154(b) by 0 days.

(21) Appl. No.: 13/375,377

(22) PCT Filed: Jun. 7, 2010

(86) PCT No.: PCT/EP2010/003410
§ 371 (c)(1),
(2), (4) Date: Nov. 30, 2011

(87) PCT Pub. No.: WO2010/142406
PCT Pub. Date: Dec. 16, 2010

(65) Prior Publication Data

US 2012/0069694 A1 Mar. 22, 2012

(30) Foreign Application Priority Data

Jun. 8, 2009 (DE) ..... 10 2009 024 176
Jan. 8, 2010 (DE) ..... 10 2010 004 206

(51) Int. Cl.
*B01F 3/04* (2006.01)
*B01F 7/00* (2006.01)
*B01F 15/00* (2006.01)

(52) U.S. Cl.
CPC ..... *B01F 3/04539* (2013.01); *B01F 7/00241* (2013.01); *B01F 2015/00084* (2013.01); *B01F 2003/04546* (2013.01); *B01F 2003/04581* (2013.01)
USPC ..... 261/87; 261/85

(58) Field of Classification Search
USPC ..... 261/84–87, 93; 366/102, 168.2–169.2, 366/170.2–170.4
See application file for complete search history.

(56) References Cited

U.S. PATENT DOCUMENTS 1,073,878 A * 9/1913 Trent ..... 366/137
1,180,170 A * 4/1916 Marsh et al. ..... 239/257
(Continued)

FOREIGN PATENT DOCUMENTS

DE G 92 01 820.3 5/1992
EP 0 021 470 A1 1/1981
(Continued)

OTHER PUBLICATIONS

1st German Office Action of Oct. 9, 2009, Partial translation.
(Continued)

*Primary Examiner* — David Sorkin
*Assistant Examiner* — Abbas Rashid
(74) *Attorney, Agent, or Firm* — Henry M Feiereisen LLC

(57) ABSTRACT

The invention relates to a stirring arrangement having a rotating stirring body (2) for stirring fluids. The stirring body (2) has stirring blades (4) attached on a stirring body hub (3). The stirring body further includes a gas supply device (5) supplying a gas, such as air, for dispersing with the stirring body (2). The gas supply device (5) includes a distribution bushing (6) which rotates with the hub (3) of the stirring body (2) and has an interior for receiving the gas. The distribution bushing (6) and the interior thereof are in fluid communication with co-rotating outlet lines (7). Outlet openings of the outlet lines (7) are disposed in the immediate vicinity of the stirring blades (4) and within the volume swept by the stirring body (2) or in the immediate outflow zones, and discharge the gas at respective desired locations in the corresponding desired flow direction.

3 Claims, 1 Drawing Sheet

(56) References Cited

U.S. PATENT DOCUMENTS

| | | | | | |
|---|---|---|---|---|---|
| 1,214,113 | A | * | 1/1917 | Anderson | 210/178 |
| 1,723,014 | A | * | 8/1929 | Dahllof | 239/259 |
| 2,288,063 | A | * | 6/1942 | Ashlock, Jr. | 261/87 |
| 2,559,518 | A | * | 7/1951 | Smith | 366/134 |
| 2,592,904 | A | * | 4/1952 | Jackson | 366/168.2 |
| 2,652,228 | A | * | 9/1953 | Merrick | 239/259 |
| 2,983,452 | A | * | 5/1961 | Lindbloom | 239/259 |
| 3,066,921 | A | * | 12/1962 | Thommel et al. | 261/30 |
| 3,227,547 | A | * | 1/1966 | Szekely | 75/558 |
| 4,184,775 | A | * | 1/1980 | Akizawa | 366/168.2 |
| 4,249,828 | A | * | 2/1981 | Condolios | 366/102 |
| 4,371,480 | A | | 2/1983 | Vos | |
| 4,688,945 | A | * | 8/1987 | Brazelton et al. | 366/156.1 |
| 5,034,131 | A | * | 7/1991 | Stenroos et al. | 210/612 |
| 5,061,080 | A | * | 10/1991 | MacKay et al. | 366/170.4 |
| 5,342,429 | A | * | 8/1994 | Yu et al. | 75/680 |
| 5,427,456 | A | * | 6/1995 | Hensel | 384/112 |
| 5,616,304 | A | * | 4/1997 | Stormo | 422/227 |
| 5,620,250 | A | * | 4/1997 | Chilcoat et al. | 366/168.2 |
| 5,744,105 | A | * | 4/1998 | Stormo | 422/227 |
| 6,346,412 | B1 | | 2/2002 | Stormo | |
| 6,439,756 | B1 | * | 8/2002 | Forschner et al. | 366/102 |
| 6,439,768 | B1 | * | 8/2002 | Wu et al. | 374/169 |
| 7,296,925 | B2 | | 11/2007 | Himmelsbach et al. | |
| 7,401,974 | B2 | | 7/2008 | Himmelsbach | |
| 2004/0228210 | A1 | | 11/2004 | Himmelsbach et al. | |
| 2006/0233043 | A1 | | 10/2006 | Himmelsbach | |
| 2007/0268779 | A1 | | 11/2007 | Himmelsbach | |
| 2010/0002533 | A1 | | 1/2010 | Himmelsbach | |
| 2010/0258509 | A1 | * | 10/2010 | Iwaki et al. | 210/749 |

FOREIGN PATENT DOCUMENTS

| | | | |
|---|---|---|---|
| EP | 0 593 074 | A1 | 4/1994 |
| EP | 0 847 709 | A1 | 6/1998 |
| EP | 1 055 450 | A2 | 11/2000 |
| WO | WO 2008/083673 | | 7/2008 |

OTHER PUBLICATIONS

2nd German Office Action of Aug. 5, 2010, Partial translation.
3rd German Office Action of Jun. 24, 2011, Partial translation.
Int. Search Report of Oct. 21, 2010 and Written Opinion.
EP Office Action of Sep. 25, 2012, Partial translation.
EP Summons Oral Proc May 17, 2013, Partial translation.
AU First OA of Dec. 21, 2011.
AU Second OA of Jun. 25, 2013.
CA OA of Apr. 17, 2013.
RU OA of Apr. 22, 2014, Partial translation.

* cited by examiner

STIRRING ARRANGEMENT

CROSS-REFERENCES TO RELATED APPLICATIONS

This application is the U.S. National Stage of International Application No. PCT/EP2010/003410, filed Jun. 7, 2010, which designated the United States and has been published as International Publication No. WO 2010/142406 and which claims the priority of German Patent Applications, Serial No. 10 2009 024 176.0, filed Jun. 8, 2009, and Serial No. 10 2010 044 206.4, filed Jan. 8, 2010, pursuant to 35 U.S.C. 119(a)-(d).

BACKGROUND OF THE INVENTION

The invention relates to a stirring arrangement with a rotating stirring body for stirring fluids, with stirring blades attached to a stirring body hub. The stirring device also includes a gas supply device which supplies a gas, such as air, for dispersing with the stirring body.

In many chemical reactors or bioreactors with a stirring arrangement, reactions occur wherein at least one reaction partner is present as a gaseous starting component. The stirring arrangement is provided to finely distribute the gaseous component and to thus provide a large boundary surface between the gaseous component or the fluid such that the gaseous component goes at least partially or entirely into solution and takes part in the reaction progressing in the reactor.

Accordingly, there are applications where the stirring arrangement must disperse a gas. The task of dispersing a gas occurs in practice mostly in conjunction with additional primary tasks, for example mixing of fluid flows having different viscosities used to introduce additional reaction partners, suspending solid materials, transferring heat to heat exchange elements, circulating the fluid to the surface for evaporating solvents, precipitating and crystallizing solid materials, etc.

To optimally solve the primary tasks, various stirring bodies have been previously developed, which may differ with respect to the transport direction, namely radial and/or axial, the number of stirring blades, the shape of the stirring blades and the number of stirring stages.

For example, U.S. Pat. No. 4,371,480 A and in DE 92 01 820 U1 describe stirring arrangements are disclosed wherein a gas is drawn in by the stirring body. Conversely, stirring arrangements with "external gas supply" are known, meaning that the gas is not drawn in by the stirring body, but is supplied by a blower or compressor or from a pressure reservoir. Several examples for conventional stirring arrangements will now be described.

WO 2008/083673 A2 discloses a stirring arrangement with a stirring body and a gas supply device of the aforedescribed type. This gas supply device supplies gas below or on the sides of the stirring body, wherein this gas is dispersed by the stirring body. With this design of the stirring arrangement, the gas is supplied and distributed either on the sides and/or below the stirring body at a relatively large distance from the stirring body.

EP 0 847 709 A1 discloses a stirring body which is used, in particular, as gas supply stirring body for stirring fluids. A gas, for example air, is supplied to the fluids. In this gas supply stirring body, the gas is supplied via a supply tube with a discharge port located below the stirring axis of the stirring body. Optionally, several supply tubes may be provided below and/or on the side spaced from the stirring body. The gas is supplied via these tubes to the outflow of the stirring body of the stirring arrangement.

EP 1 055 450 B1 shows a stirring arrangement, wherein the gas is supplied via co-rotating distribution elements.

As can be seen from the aforedescribed stirring arrangements, stirring arrangements having an external gas supply can be divided into two different cases.

The gas may be supplied via stationarily installed supply lines, for example via tubes arranged below the stirring body or tubes arranged on the side next to the stirring body or a ring-shape gas distributor, a so-called ring shower arranged below the stirring body. Such ring shower has several openings distributed along its circumference, through which the gas to be supplied to the stirring body can exit.

Gas can also be supplied through co-rotating distribution elements, as is the case for the stirring arrangement described in EP 1 055 450 B1. However, if the stirring body of this stirring arrangement must satisfy one of the aforementioned primary tasks in addition actually supplying the gas, the rotating distribution elements for supplying gas are arranged outside the actual stirring body, preventing an optimal gas supply.

The conventional embodiments of gas supply devices include several individual and separate components which require associated rigid supports to prevent flow-induced oscillations. It may also be necessary to use expensive materials, duplex steels, alloys or titanium to prevent corrosion. Overall, the conventional gas supply devices are therefore complex, include several components and are complex and cost-intensive to manufacture.

It is therefore an object of the invention to provide a gas supply to the stirring body of a stirring arrangement, which has a very simple structure while simultaneously attaining a significant cost reduction, and to also achieve a targeted gas discharge at any location of the stirring body or the stirring blades desired for the flow mechanics. In particular, the gas should be optimally dispersed without adversely affecting the primary task of the stirring arrangement.

SUMMARY OF THE INVENTION

According to the invention, a stirring arrangement with a rotating stirring body for stirring fluids is provided, wherein the stirring body has stirring blades mounted on a stirring body hub, and with a gas supply device supplying a gas, such as air, for dispersing with the stirring body, wherein the stirring arrangement is distinguished in that the gas supply device includes a distribution bushing which rotates with the hub of the stirring body and which has an interior space for receiving the gas, wherein the interior space is in fluid communication with co-rotating outlet lines. The invention is characterized in that outlet openings of the outlet lines are arranged in immediate vicinity of the stirring blades and within the volume swept by the stirring body or in the immediate outflow zones and discharge the gas at desired locations in the corresponding desired flow direction.

In the stirring arrangement according to the invention, co-rotating outlet lines with outlet openings are provided in the immediate vicinity of the stirring blades, simplifying their support and attachment. These outlet lines also allow discharging the gas in a targeted manner at any location of the stirring body and/or of the stirring blades favorable for the flow mechanics. The gas is conducted from the distribution bushing to the corresponding desired outlet openings through the co-rotating outlet lines. By arranging the outlet openings of the outlet lines according to the invention in the immediate vicinity of the stirring blades and within the volume swept by the stirring body or in the immediate outflow zones, the gas is optimally dispersed, while simultaneously preventing any interference with fulfillment of a primary task of the stirring arrangement.

The gas supply device preferably also includes a standing supply line, which has a sealed connection for fluid communication with the interior space of the rotating distribution bushing. The gaseous component is supplied to the stirring body through a single central supply line, thus significantly simplifying the structure of a stirring arrangement which includes a stirring body and a gas supply device. The standing central supply line has a sealed connection for fluid communication with the interior space of a central distribution bushing which rotates with the hub of the stirring body.

The design of the stirring arrangement according to the invention thus includes a central gas supply line, which is then in fluid communication with co-rotating devices, such as a distribution bushing, with the likewise co-rotating outlet lines. In this way, a structurally significantly simplified gas supply is realized with this type of stirring arrangement with gas supply device.

In order to attain a very compact structure of the stirring arrangement, the rotating distribution bushing is arranged coaxially and below the stirring body hub. This produces an optimal space-saving arrangement and structure of the rotating distribution organ.

In particular, according to the invention, the gas supply locations formed by the outlet openings of the outlet lines are located within the volume swept by the stirring body. The outlet lines thereby allow in the stirring arrangement according to the invention a free selection of the optimal locations for releasing the gas in the immediate vicinity of the stirring blades. Both the outflow direction of the supplied gas as well as the outflow location can be optimally selected by taking into account the respective design of the stirring body.

The outlet lines coming off the distribution bushing may extend separate from the stirring blades and their discharge openings, or outlet openings may be located above the blade height or the blade periphery. The discharge openings or outlets of the outlet lines may be located in the region of the stirring body blades; other designs are possible where the discharge openings are located between the stirring body blades.

According to an alternative embodiment, the outlet lines may be integrated in the stirring blades of the stirring body.

The transition from the standing supply line and the distribution bushing co-rotating with the stirring body, wherein the outlet lines are in fluid communication with the interior space of the distribution bushing, should be designed such that the quantity of lost fluid at the transition from standing to rotating part is as small as possible, thus providing a reliable seal in the transition region. According to the invention, a hydrostatic seal may be provided in this transition region, or a substantially wear-free arrangement with an axial or radial gap implementing the desired sealing function may be provided.

In summary, it is important with the stirring arrangement according to the invention to arrive at a structurally simplified supply line to the stirring body with the smallest possible number of individual parts. Accordingly, a single central gas supply is provided with the invention which is stationary and cooperates with a rotating distribution bushing having an interior space forming a gas receiving space. The co-rotating outlet lines are then supplied from this central co-rotating distribution bushing, and these co-rotating outlet lines with outlet openings disposed in the immediate vicinity to the stirring blades and within the volume swept by the stirring body or in the immediate outflow zones can then discharge the supplied gas at the respective most favorable locations in order to optimize the stirring arrangement and to thereby also impart a desired flow direction on this supplied gas flow so as to improve the participation of the gas in the reaction.

BRIEF DESCRIPTION OF THE DRAWING

Preferred embodiments of the invention will now be described in more detail with reference to the appended drawing which is only exemplary and does not represent a limitation. The drawing shows in.

DETAILED DESCRIPTION OF PREFERRED EMBODIMENTS

Figure 1:
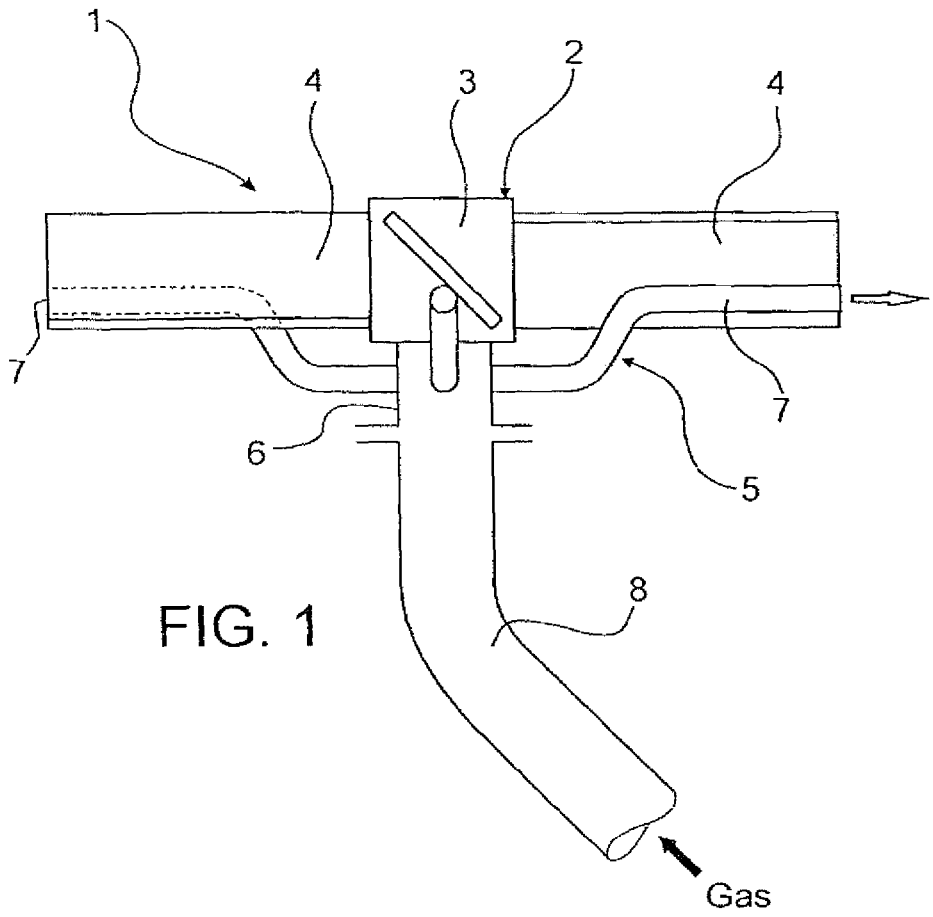
FIG. 1 a schematic side view of a stirring arrangement with a stirring body and a gas supply device according to the invention.

In the figures of the drawing, identical or similar elements are labeled with identical reference symbols.

FIG. 1 shows a first embodiment of a stirring arrangement having the overall reference symbol 1. The stirring arrangement 1 has a rotating stirring body 2 designed for stirring liquids. The stirring body 2 includes a stirring body hub 3 to which stirring blades 4 are attached. The sealing blades 4 may have any desired shape and design.

The stirring arrangement 1 also includes a gas supply device indicated with the overall reference symbol 5, which supplies a gas, such as air, to the stirring organ 2 for dispersing. The gas supply device 5 includes a distribution bushing 6 co-rotating with the stirring body hub 3 of the stirring organ 2. The distribution bushing 6 encloses an interior space configured to receive gas. The distribution bushing 6 and/or the interior space thereof are in fluid communication with co-rotating outlet lines 7 which discharge the gas at respective desired locations with the corresponding desired flow direction. The gas supply device 5 furthermore includes a standing supply line 8 which has a sealed connection for fluid communication with the interior space of the rotating distribution bushing 6. In this exemplary embodiment illustrated in FIG. 1, the co-rotating outlet lines 7 are formed separate from the stirring blades 4.

In the stirring arrangement illustrated in FIG. 1, a single central standing supply line 8 is provided for a gas to be supplied. The distribution bushing 6 is arranged coaxially and below the stirring body hub 3 having the interior space for receiving gas. The standing or stationary supply line 8 and the rotating distribution bushing 6 have a sealed connection for fluid communication with each other. The structure is hereby selected such that the quantity of lost fluid at the seal of the transition between standing supply line 8 and rotating distribution bushing 6 is as small as possible. For this purpose, a hydrostatic seal can be provided at this transition region, or the sealed connection between stationary supply line 8 and rotating distribution bushing 6 is implemented with a wear-free arrangement having an axial or radial gap.

In the design of the stirring arrangement 1 according to the invention, the gas introduced into the interior space of the rotating distribution bushing 6 through the stationary supply line 8 is released through the co-rotating outlet lines 7 of the gas supply device 5 at a respective desired suitable location, wherein the supply locations are located within the volume swept by the stirring organ 2. However, the gas can also be discharged and released at the discharge openings of the co-rotating outlet lines 7 with a corresponding desired flow direction. These discharge openings of the outlet lines 7 may be located in the region of the stirring blades 4, or they may also be arranged between the stirring blades 4. However, they are always arranged in the immediate vicinity of the stirring blades and within the volume swept by the stirring body. These discharge openings of the outlet lines 7 may also be located above or below the height of the stirring blades 4. The most favorable locations for the outlet openings of the outlet lines 7 and the most favorable discharge directions may be optimally selected depending on the type of the stirring organ 2. In particular, savings in installation costs and/or material cost can be achieved with the compact design of the gas supply device 5. Because the outlet lines 7 also co-rotate, the rigid supports for the outlet lines for preventing flow-induced oscillations can be eliminated.

The stirring arrangement 1 according to the invention is relatively cost-effective due to its inventive design and also has a simpler structure. The stirring body 2 of the stirring arrangement 1 according to the invention is therefore able to very efficiently disperse the supplied gas, so that optimal reaction conditions of gas and fluid in a reactor can be realized.

Figure 2:
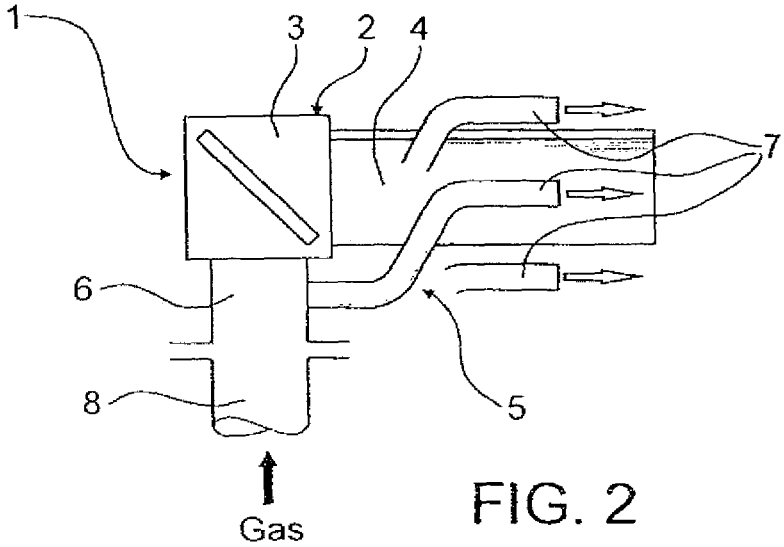
FIG. 2 a schematic side view of a stirring arrangement with a stirring organ and a gas supply device according to a modified embodiment of the invention.

FIG. 2 shows examples of alternative embodiments of the outlet lines 7 as well as well of the orientations and arrangements of the discharge openings thereof. In an illustrated example, the outlet line 7 is integrated in the associated stirring blade 4. All additional details of the stirring arrangement 1' according to FIG. 2 are identical with the details of the stirring arrangement 1 according to FIG. 1. A more detailed explanation is therefore unnecessary.

The invention is not limited to the details of the illustrated embodiments, and numerous changes and modifications are possible which the skilled artisan will make as needed without going beyond the scope of the invention. For example, combinations of the embodiments of outlet lines 7 are also feasible, wherein the outlet lines 7 are partially integrated in the stirring blades 4 and partially separate from the stirring blades. The discharge openings of the co-rotating outlet lines 7 may then be alternatingly arranged at different locations in relation to the stirring body 2, and the discharge openings themselves may also be formed differently to impart the respective desired flow direction component on the exiting gas flow. However, according to the invention, these discharge or outlet openings should be located in the immediate vicinity of the stirring blades and within the volume swept by the stirring body.

The invention claimed is:

1. A stirring arrangement comprising:

a rotating stirring body comprising a stirring body hub and stirring blades mounted on the stirring body hub for stirring fluids, and a gas supply device supplying a gas to be dispersed by the stirring body, wherein the gas supply device comprises a rotating distribution bushing which rotates with the stirring body hub and is arranged coaxially with and below the stirring body hub and includes an interior space for receiving the gas and a stationary supply line, with the stationary supply line having a sealed connection implemented with a hydrostatic seal for fluid communication with the interior space of the rotating distribution bushing, and outlet lines in fluid communication with the interior space and co-rotating with the interior space, wherein the outlet lines comprise outlet openings arranged in immediate vicinity of the stirring blades and within a volume swept by the stirring body, and discharging the gas at desired locations in a corresponding desired flow direction.

2. The stirring arrangement of claim 1, wherein the outlet lines run separate relative to the stirring blades.

3. The stirring arrangement of claim 1, wherein the outlet lines are integrated in the stirring blades.

* * * * *